US011492886B2

(12) United States Patent
Oehring et al.

(10) Patent No.: US 11,492,886 B2
(45) Date of Patent: Nov. 8, 2022

(54) SELF-REGULATING FRAC PUMP SUCTION STABILIZER/DAMPENER

(71) Applicant: U.S. Well Services, LLC, Houston, TX (US)

(72) Inventors: Jared Oehring, Houston, TX (US); Alexander Christinzio, Houston, TX (US); Lon Robinson, Houston, TX (US)

(73) Assignee: U.S. Wells Services, LLC, Houston, TX (US)

( * ) Notice: Subject to any disclaimer, the term of this patent is extended or adjusted under 35 U.S.C. 154(b) by 128 days.

(21) Appl. No.: 17/136,913

(22) Filed: Dec. 29, 2020

(65) Prior Publication Data

US 2021/0198995 A1 Jul. 1, 2021

Related U.S. Application Data

(60) Provisional application No. 62/955,763, filed on Dec. 31, 2019.

(51) Int. Cl.
*E21B 43/26* (2006.01)
*F04B 17/03* (2006.01)
(Continued)

(52) U.S. Cl.
CPC ..... *E21B 43/2607* (2020.05); *E21B 34/08* (2013.01); *E21B 34/142* (2020.05); *F04B 17/03* (2013.01); *E21B 43/2605* (2020.05)

(58) Field of Classification Search
CPC ..... F04B 2205/03; F04B 39/0027; F04B 39/0038; F04B 19/06; F04B 15/02;
(Continued)

(56) References Cited

U.S. PATENT DOCUMENTS 2,976,025 A 3/1961 Pro
3,878,884 A 4/1975 Raleigh
(Continued)

FOREIGN PATENT DOCUMENTS

CN 104117308 A 10/2014
CN 104196613 A 12/2014
(Continued)

OTHER PUBLICATIONS

Non-Final Office Action issued in U.S. Appl. No. 16/871,928 dated Aug. 25, 2021.
(Continued)

*Primary Examiner* — Kenneth L Thompson
(74) *Attorney, Agent, or Firm* — Hogan Lovells US LLP

(57) ABSTRACT

A hydraulic fracturing pump system includes an electric powered hydraulic fracturing pump positioned on a support structure. The system also includes a suction stabilizer/dampener coupled to a suction end of the pump. The system further includes a compressed gas supply, fluidly coupled to the suction stabilizer/dampener, and positioned on the support structure. The system also includes a flow path between the suction stabilizer/dampener and the compressed gas supply, the flow path including at least one valve and at least one regulator configured to control flow from the compressed gas supply to the suction stabilizer/dampener.

20 Claims, 6 Drawing Sheets

(51) Int. Cl.
*E21B 34/14* (2006.01)
*E21B 34/08* (2006.01)

(58) Field of Classification Search
CPC ..... F04B 11/0025; F04B 11/0016; F04B 11/0008; F04B 11/00; E21B 43/2605; E21B 43/2607
See application file for complete search history.

(56) References Cited

U.S. PATENT DOCUMENTS

| | | | | |
|---|---|---|---|---|
| 4,411,313 | A | 10/1983 | Johnson et al. | |
| 4,538,916 | A | 9/1985 | Zimmerman | |
| 4,601,629 | A | 7/1986 | Zimmerman | |
| 4,768,884 | A | 9/1988 | Elkin | |
| 5,114,239 | A | 5/1992 | Allen | |
| 5,334,899 | A | 8/1994 | Skybyk | |
| 5,439,066 | A | 8/1995 | Gipson | |
| 5,486,047 | A | 1/1996 | Zimmerman | |
| 5,798,596 | A | 8/1998 | Lordo | |
| 5,813,455 | A | 9/1998 | Pratt et al. | |
| 5,950,726 | A | 9/1999 | Roberts | |
| 6,035,265 | A | 3/2000 | Dister et al. | |
| 6,097,310 | A | 8/2000 | Harrell et al. | |
| 6,121,705 | A | 9/2000 | Hoong | |
| 6,273,193 | B1 | 8/2001 | Hermann et al. | |
| 6,442,942 | B1 | 9/2002 | Kopko | |
| 6,585,455 | B1 | 7/2003 | Petersen et al. | |
| 6,788,022 | B2 | 9/2004 | Sopko | |
| 6,985,750 | B1 | 1/2006 | Vicknair et al. | |
| 7,795,830 | B2 | 9/2010 | Johnson | |
| 8,146,665 | B2 * | 4/2012 | Neal | E21B 21/003 166/305.1 |
| 9,062,545 | B2 | 6/2015 | Roberts et al. | |
| 9,140,105 | B2 | 9/2015 | Pattillo | |
| 9,353,593 | B1 | 5/2016 | Lu et al. | |
| 9,506,333 | B2 | 11/2016 | Castillo et al. | |
| 9,790,858 | B2 | 10/2017 | Kanebako | |
| 9,945,365 | B2 | 4/2018 | Hernandez et al. | |
| 10,221,639 | B2 | 3/2019 | Romer et al. | |
| 10,408,030 | B2 | 9/2019 | Oehring et al. | |
| 10,408,031 | B2 | 9/2019 | Oehring et al. | |
| 10,415,332 | B2 | 9/2019 | Morris et al. | |
| 10,422,327 | B2 * | 9/2019 | Horwath | F04B 49/065 |
| 10,591,101 | B2 * | 3/2020 | Smith | F16L 55/053 |
| 10,648,270 | B2 | 5/2020 | Brunty et al. | |
| 10,648,311 | B2 | 5/2020 | Oehring et al. | |
| 10,686,301 | B2 | 6/2020 | Oehring et al. | |
| 10,731,561 | B2 | 8/2020 | Oehring et al. | |
| 10,740,730 | B2 | 8/2020 | Altamirano et al. | |
| 10,767,561 | B2 | 9/2020 | Brady | |
| 10,781,752 | B2 | 9/2020 | Kikkawa et al. | |
| 10,794,165 | B2 | 10/2020 | Fischer et al. | |
| 10,988,998 | B2 | 4/2021 | Fischer et al. | |
| 11,193,361 | B1 * | 12/2021 | Yeung | F16B 7/0426 |
| 2001/0000996 | A1 | 5/2001 | Grimland et al. | |
| 2004/0045703 | A1 | 3/2004 | Hooper et al. | |
| 2005/0201197 | A1 | 9/2005 | Duell et al. | |
| 2006/0109141 | A1 | 5/2006 | Huang | |
| 2008/0164023 | A1 | 7/2008 | Dykstra et al. | |
| 2008/0257449 | A1 | 10/2008 | Weinstein et al. | |
| 2008/0277120 | A1 | 11/2008 | Hickie | |
| 2009/0072645 | A1 | 3/2009 | Quere | |
| 2011/0081268 | A1 | 4/2011 | Ochoa et al. | |
| 2011/0110793 | A1 | 5/2011 | Leugemores et al. | |
| 2012/0063936 | A1 | 3/2012 | Baxter et al. | |
| 2012/0112757 | A1 | 5/2012 | Vrankovic et al. | |
| 2012/0150455 | A1 | 6/2012 | Franklin et al. | |
| 2013/0051971 | A1 | 2/2013 | Wyse et al. | |
| 2013/0284455 | A1 | 10/2013 | Kajaria et al. | |
| 2014/0174717 | A1 | 6/2014 | Broussard et al. | |
| 2015/0147194 | A1 | 5/2015 | Foote | |
| 2015/0233530 | A1 | 8/2015 | Sandidge | |
| 2016/0006311 | A1 | 1/2016 | Li | |
| 2016/0230660 | A1 | 8/2016 | Zeitoun et al. | |
| 2016/0326853 | A1 | 11/2016 | Fred et al. | |
| 2017/0082033 | A1 | 3/2017 | Wu et al. | |
| 2017/0096889 | A1 | 4/2017 | Blanckaert et al. | |
| 2017/0204852 | A1 | 7/2017 | Barnett | |
| 2017/0212535 | A1 | 7/2017 | Shelman et al. | |
| 2017/0370639 | A1 | 12/2017 | Barden et al. | |
| 2018/0090914 | A1 | 3/2018 | Johnson et al. | |
| 2018/0181830 | A1 | 6/2018 | Luharuka et al. | |
| 2018/0259080 | A1 | 9/2018 | Dale et al. | |
| 2018/0266217 | A1 | 9/2018 | Funkhauser et al. | |
| 2018/0284817 | A1 | 10/2018 | Cook et al. | |
| 2018/0298731 | A1 | 10/2018 | Bishop | |
| 2018/0312738 | A1 | 11/2018 | Rutsch et al. | |
| 2018/0313677 | A1 | 11/2018 | Warren et al. | |
| 2018/0363640 | A1 | 12/2018 | Kajita et al. | |
| 2018/0366950 | A1 | 12/2018 | Pedersen et al. | |
| 2019/0040727 | A1 | 2/2019 | Oehring et al. | |
| 2019/0128104 | A1 | 5/2019 | Graham et al. | |
| 2019/0145251 | A1 | 5/2019 | Johnson | |
| 2019/0154020 | A1 | 5/2019 | Glass | |
| 2019/0249527 | A1 | 8/2019 | Kraynek | |
| 2019/0257462 | A1 | 8/2019 | Rogers | |
| 2020/0040878 | A1 | 2/2020 | Morris | |
| 2020/0232454 | A1 * | 7/2020 | Chretien | F04B 49/065 |
| 2020/0325760 | A1 | 10/2020 | Markham | |
| 2020/0350790 | A1 | 11/2020 | Luft et al. | |
| 2021/0363979 | A1 * | 11/2021 | Fox | F04B 43/0081 |

FOREIGN PATENT DOCUMENTS

| | | |
|---|---|---|
| CN | 112196508 A | 1/2021 |
| WO | 2009046280 | 4/2009 |
| WO | 2014177346 | 11/2014 |
| WO | 2018044307 A1 | 3/2018 |
| WO | 2018213925 A1 | 11/2018 |
| WO | 2019210417 | 11/2019 |

OTHER PUBLICATIONS

Non-Final Office Action issued in U.S. Appl. No. 16/943,727 dated Aug. 3, 2021.
Non-Final Office Action issued in U.S. Appl. No. 14/881,525 dated Jul. 21, 2021.
Non-Final Office Action issued in U.S. Appl. No. 16/404,283 dated Jul. 21, 2021.
Notice of Allowance and Notice of Allowability issued in U.S. Appl. No. 15/829,419 dated Jul. 26, 2021.
Woodbury et al., "Electrical Design Considerations for Drilling Rigs," IEEE Transactions on Industry Applications, vol. 1A-12, No. 4, Jul./Aug. 1976, pp. 421-431.
Kroposki et al., Making Microgrids Work, 6 IEEE Power and Energy Mag. 40, 41 (2008).
Dan T. Ton & Merrill A. Smith, The U.S Department of Energy's Microgrid Initiative, 25 The Electricity J. 84 (2012), pp. 84-94.
Non-Final Office Action issued in U.S. Appl. No. 16/871,328 dated Dec. 9, 2021.
Non-Final Office Action issued in U.S. Appl. No. 16/943,935 dated Oct. 21, 2021.
Non-Final Office Action issued in U.S. Appl. No. 16/564,186, dated Oct. 15, 2021.
Final Office Action issued in U.S. Appl. No. 16/356,263 dated Oct. 7, 2021.
Non-Final Office Action issued in U.S. Appl. No. 17/060,647 dated Sep. 20, 2021.
Non-Final Office Action issued in U.S. Appl. No. 16/901,774 dated Sep. 14, 2021.
Canadian Office Action issued in Canadian Application No. 3,094,768 dated Oct. 28, 2021.
International Search Report and Written Opinion mailed in PCT/US20/67526 dated May 6, 2021.
International Search Report and Written Opinion mailed in PCT/US20/67608 dated Mar. 30, 2021.
International Search Report and Written Opinion mailed in PCT/US20/67528 dated Mar. 19, 2021.

(56) References Cited

OTHER PUBLICATIONS

International Search Report and Written Opinion mailed in PCT/US20/67146 dated Mar. 29, 2021.
International Search Report and Written Opinion mailed in PCT/US20/67523 dated Mar. 22, 2021.
International Search Report and Written Opinion mailed in PCT/US2020/066543 dated May 11, 2021.
Morris et al., U.S. Appl. No. 62/526,869; Hydration-Blender Transport and Electric Power Distribution for Fracturing Operation; filed Jun. 28, 2018; USPTO; see entire document.
Final Office Action dated Feb. 4, 2021 in U.S. Appl. No. 16/597,014.
International Search Report and Written Opinion dated Feb. 4, 2021 in PCT/US20/59834.
International Search Report and Written Opinion dated Feb. 2, 2021 in PCT/US20/58906.
International Search Report and Written Opinion dated Feb. 3, 2021 in PCT/US20/58899.
Non-Final Office Action dated Jan. 29, 2021 in U.S. Appl. No. 16/564,185.
Final Office Action dated Jan. 21, 2021 in U.S. Appl. No. 16/458,696.
Final Office Action dated Jan. 11, 2021 in U.S. Appl. No. 16/404,283.
Non-Final Office Action dated Jan. 4, 2021 in U.S. Appl. No. 16/522,043.
International Search Report and Written Opinion dated Dec. 14, 2020 in PCT/US2020/53980.

* cited by examiner

SELF-REGULATING FRAC PUMP SUCTION STABILIZER/DAMPENER

CROSS REFERENCE TO RELATED APPLICATIONS

This application claims priority to and the benefit of U.S. Provisional Application Ser. No. 62/955,763 filed Dec. 31, 2019 titled "SELF-REGULATING FRAC PUMP SUCTION STABILIZER/DAMPENER," the full disclosure of which is hereby incorporated herein by reference in its entirety for all purposes.

BACKGROUND

1. Technical Field

This disclosure relates generally to hydraulic fracturing and more particularly to systems and methods for regulating pumping operations.

2. Background

With advancements in technology over the past few decades, the ability to reach unconventional sources of hydrocarbons has tremendously increased. Horizontal drilling and hydraulic fracturing are two such ways that new developments in technology have led to hydrocarbon production from previously unreachable shale formations. Hydraulic fracturing (fracturing) operations typically require powering numerous components in order to recover oil and gas resources from the ground. For example, hydraulic fracturing usually includes pumps that inject fracturing fluid down the wellbore, blenders that mix proppant into the fluid, cranes, wireline units, and many other components that all must perform different functions to carry out fracturing operations.

Usually in fracturing systems the fracturing equipment runs on diesel-generated mechanical power or by other internal combustion engines. Such engines may be very powerful, but have certain disadvantages. Diesel is more expensive, is less environmentally friendly, less safe, and heavier to transport than natural gas. For example, heavy diesel engines may require the use of a large amount of heavy equipment, including trailers and trucks, to transport the engines to and from a wellsite. In addition, such engines are not clean, generating large amounts of exhaust and pollutants that may cause environmental hazards, and are extremely loud, among other problems. Onsite refueling, especially during operations, presents increased risks of fuel leaks, fires, and other accidents. The large amounts of diesel fuel needed to power traditional fracturing operations requires constant transportation and delivery by diesel tankers onto the well site, resulting in significant carbon dioxide emissions.

Some systems have tried to eliminate partial reliance on diesel by creating bi-fuel systems. These systems blend natural gas and diesel, but have not been very successful. It is thus desirable that a natural gas powered fracturing system be used in order to improve safety, save costs, and provide benefits to the environment over diesel powered systems. Turbine use is well known as a power source, but is not typically employed for powering fracturing operations.

Though less expensive to operate, safer, and more environmentally friendly, turbine generators come with their own limitations and difficulties as well. As is well known, turbines generally operate more efficiently at higher loads.

Many power plants or industrial plants steadily operate turbines at 98% to 99% of their maxim um potential to achieve the greatest efficiency and maintain this level of use without significant difficulty. This is due in part to these plants having a steady power demand that either does not fluctuate (i.e., constant power demand), or having sufficient warning if a load will change (e.g., when shutting down or starting up a factory process).

Space is at a premium at a fracturing site, where different vendors are often working simultaneously to prepare for a fracturing operation. As a result, utilizing systems that have large footprints may be undesirable. However, pressure pumpers still need to be able to provide sufficient pumping capacity in order to complete fracturing jobs.

During operations, a slurry solution is directed toward a fracturing pump, such as a positive displacement pump, and is charged in order to reduce fluid pulsations and pressure fluctuations. Often, a charging unit is provided, which has a separate set of maintenance and operation steps. As a result, additional time is lost at the site, along with an increased footprint and complicated set up.

SUMMARY

Applicant recognized the problems noted above herein and conceived and developed embodiments of systems and methods, according to the present disclosure, for pump control operations.

In an embodiment, a complete self-regulating system includes plumbing air (or other substance) lines, regulators, and valves on a frac pump (or other locations within the system) in order to utilize an existing air supply located within the tractor that the pump trailers are connected to. Additionally, in embodiments, a centralized source could be deployed on location and tied into this self-regulating system. This would serve as new configuration and set up creating an improvement to the system. It also is an improvement to the process of maintaining these units, eliminating the need to manually transport a supply to each individual unit.

In an embodiment, plumbing is provided from a supply source from the tractor or centralized source. Also, embodiments include regulators and valves so that the dampener can be re-charged without the need of hooking up a supply source each time a unit needs re-filled. Gauges are also installed so a visual can be seen on what the current charge pressure is. Other sensors, probes, meters, monitors could be utilized along with some intelligent local or remote algorithm that would further self-regulate pressure without the need of human interaction In an embodiment, air lines from the tractor's trailer air tank feeding into a ball valve and then an air pressure regulator. From there, additional air lines feed into the inlet of the suction dampener/stabilizer. The regulator is manual at this time and depends on a human to set pressure and open the ball valve. However, embodiments may incorporate sensors detecting pressure and automated valves and regulators that could recharge the system when low-pressure limits are reached, as well as bleed off pressure if a high pressure limit were to be reached. Embodiments may also include replacement of individual pump suction dampeners/stabilizers with one single unit placed prior to the pumps. This could be on the suction side of the blender, the discharge side of the blender, on the supply missile or another location within the system. Additionally, multiple units that serve two or more pumps may be deployed.

In an embodiment, a hydraulic fracturing pump system includes an electric powered hydraulic fracturing pump, a suction stabilizer/dampener coupled to a suction end of the pump, a compressed gas supply, fluidly coupled to the suction stabilizer/dampener, and a control system (e.g., dampener control system) positioned along a flow path between the suction stabilizer/dampener and the compressed gas supply. The control system includes a valve, a regulator, and a sensor. The system may also include an electronic control system, which may include an electronics package to operate the pump, gas supply, etc. Accordingly, it should be appreciated that the pump system may be formed form individual subsystems that may cooperate to enable operations of the pump system.

In an embodiment, a method for controlling a pumping operation includes charging a suction stabilizer/dampener via a compressed gas supply. The method also includes determining a charge pressure of the suction stabilizer/dampener is within a threshold of a target pressure. The method further includes setting a pressure control device, along a flow path between the suction stabilizer/dampener and the compressed gas supply. The method also includes operating a hydraulic fracturing pump coupled to the suction stabilizer/dampener.

In an embodiment, a hydraulic fracturing pump system includes an electric powered hydraulic fracturing pump positioned on a support structure. The system also includes a suction stabilizer/dampener coupled to a suction end of the pump. The system further includes a compressed gas supply, fluidly coupled to the suction stabilizer/dampener, and positioned on the support structure. The system also includes a flow path between the suction stabilizer/dampener and the compressed gas supply, the flow path including at least one valve and at least one regulator configured to control flow from the compressed gas supply to the suction stabilizer/dampener.

BRIEF DESCRIPTION OF DRAWINGS

Some of the features and benefits of the present disclosure having been stated, others will become apparent as the description proceeds when taken in conjunction with the accompanying drawings, in which.

Figure 1:
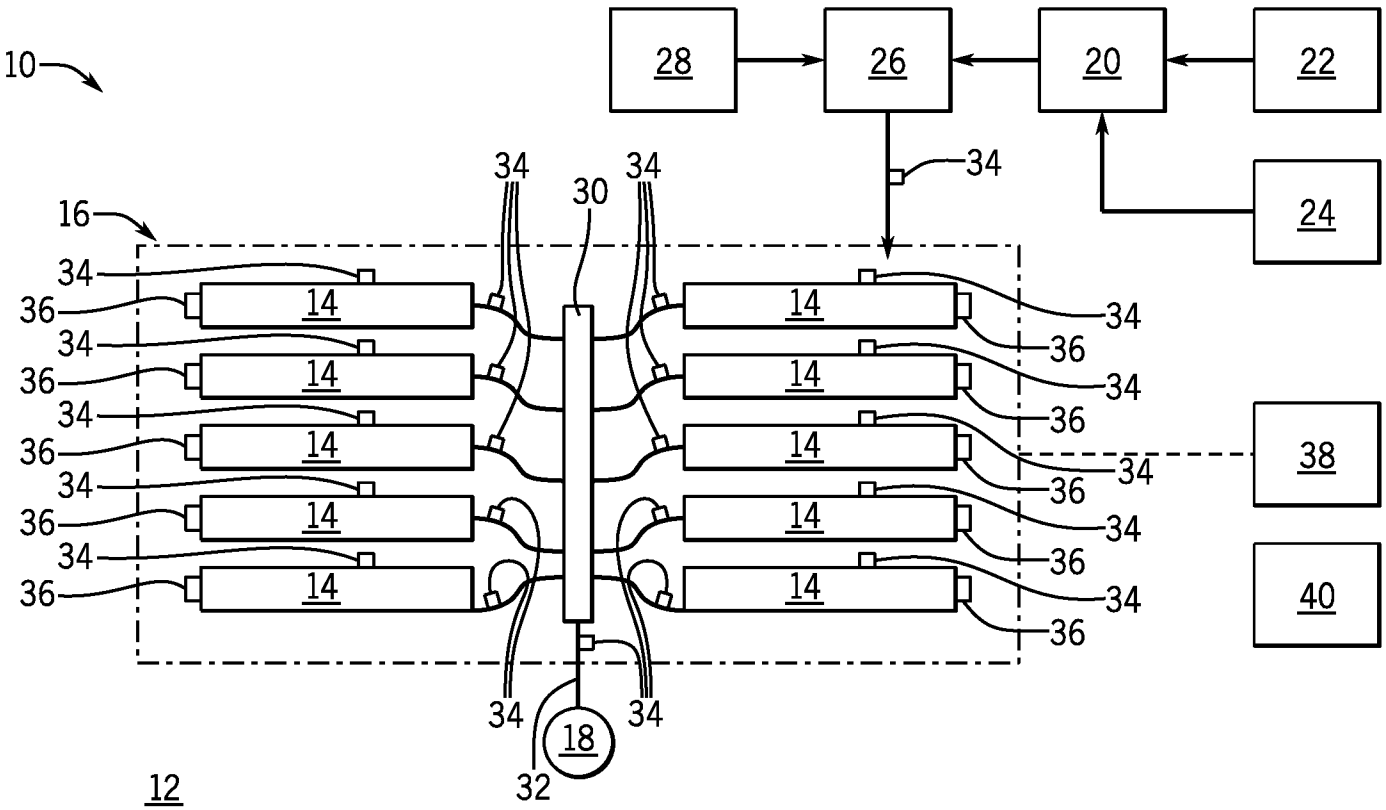
FIG. 1 is a schematic plan view of an embodiment of a fracturing operation, in accordance with embodiments of the present disclosure.

While the disclosure will be described in connection with the preferred embodiments, it will be understood that it as not intended to limit the disclosure to that embodiment. On the contrary, it is intended to cover all alternatives, modifications, and equivalents, as may be included within the spirit and scope of the disclosure as defined by the appended claims.

DETAILED DESCRIPTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

When introducing elements of various embodiments of the present disclosure, the articles "a", "an", "the", and "said" are intended to mean that there are one or more of the elements. The terms "comprising", "including", and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments", or "other embodiments" of the present disclosure are not intended to be interpreted as excluding the existence of additional embodiments that also incorporate the recited features. Furthermore, reference to terms such as "above", "below", "upper", "lower", "side", "front", "back", or other terms regarding orientation or direction are made with reference to the illustrated embodiments and are not intended to be limiting or exclude other orientations or directions. Additionally, recitations of steps of a method should be understood as being capable of being performed in any order unless specifically stated otherwise. Furthermore, the steps may be performed in series or in parallel unless specifically stated otherwise.

Current systems, in order to maintain proper charge, use an air tank or nitrogen bottle brought to each individual pump truck. This tank or bottle is hooked up to the dampener and used to fill or charge the system. This current process is time consuming and involves multiple steps in the process. Embodiments of the present disclosure overcome these challenges by enabling an operator (or automatic actuator) to open a valve and adjust a regulator to allow the system to be filled/charged. Using a regulator, a set pressure may be dialed in (e.g., set) prior to opening the valve so that the system is charged to a desire pressure. Current methods rely on operators (e.g., human operators) to fill the dampener and stop filling periodically in order to place a pressure gauge to check that status of the fill/charge. This process may be time consuming and inefficient, and moreover, may position an operator in close contact with equipment. Embodiments of the present disclosure over this problem and further reduce the need to transport and connect a supply source to each individual unit.

Embodiments of the present disclosure provide a self-regulating stabilizer/dampener that utilizes a ready source of gas (e.g., air) during pumping operations. As noted, during pumping, the suction stabilizer/dampener may be utilized to smooth or reduce fluid pulsations and pressure fluctuations. The suction stabilizer/dampener is charged (e.g., pressurized) using a gas, which may be provided using a vessel or tank. The compressed gas acts as a diaphragm or bladder to energize the system. Maintenance operations may be time consuming, and as a result, embodiments of the present disclosure simplify the process by providing a plumbing configuration, which couples an available supply source, such as from a nearby trailer, to the stabilizer/dampener and includes a regulator within the line. As a result, pressure provided to the stabilizer/dampener may be controlled, thereby reducing operator involvement. Moreover, embodiments may include an automated system when the regulator and an associated valve are both automatically controlled, thereby providing a configuration where an operator may not be involved with pressurizing the stabilizer/dampener.

FIG. 1 is a plan schematic view of an embodiment of a hydraulic fracturing system 10 positioned at a well site 12. In the illustrated embodiment, pumping units 14 (e.g., pump trucks), which make up a pumping system 16, are used to pressurize a slurry solution for injection into a wellhead 18. An optional hydration unit 20 receives fluid from a fluid source 22 via a line, such as a tubular, and also receives additives from an additive source 24. In an embodiment, the fluid is water and the additives are mixed together and transferred to a blender unit 26 where proppant from a proppant source 28 may be added to form the slurry solution (e.g., fracturing slurry) which is transferred to the pumping system 16. The pumping units 14 may receive the slurry solution at a first pressure (e.g., 80 psi to 160 psi) and boost the pressure to around 15,000 psi for injection into the wellhead 18. In certain embodiments, the pumping units 14 are powered by electric motors.

After being discharged from the pump system 16, a distribution system 30, such as a missile, receives the slurry solution for injection into the wellhead 18. The distribution system 30 consolidates the slurry solution from each of the pump trucks 14 and includes discharge piping 32 coupled to the wellhead 18. In this manner, pressurized solution for hydraulic fracturing may be injected into the wellhead 18.

In the illustrated embodiment, one or more sensors 34, 36 are arranged throughout the hydraulic fracturing system 10 to measure various properties related to fluid flow, vibration, and the like. In embodiments, the sensors 34, 36 transmit flow data to a data van 38 for collection and analysis, among other things. Furthermore, while not pictured in FIG. 1, there may be various valves distributed across the system. For examples, a manifold (not pictured) may be utilized to supply fluid to the pumping units 14 and/or to receive the pressurized fluid from the pumping units 14. Valves may be distributed to enable isolation of one or more components. As an example, there may be valves arranged to enable isolation of individual pumping units 14. Furthermore, various support units may also include valves to enable isolation. As noted above, it may be desirable to isolate singular pumping units 14 or the like if operation upsets are detected. This would enable operations to continue, although at a lower rate, and may potential environmental or personnel hazards, as well as prevent increased damage to the components. However, during operations, personnel may be evacuated or otherwise restricted from entering a pressure zone. Embodiments of the present disclosure may enable remote operation of the valves and, in various embodiments, may enable electrical control using electric energy provided on site, such as through a generator or the like.

A power generation system 40 is shown, which may include turbines, generators, switchgears, transformers, and the like. In various embodiments, the power generation system 40 provides energy for one or more operations at the well site. It should be appreciated that while various embodiments of the present disclosure may describe electric motors powering the pumping units 14, in embodiments, electrical generation can be supplied by various different options, as well as hybrid options. Hybrid options may include two or more of the following electric generation options: Gas turbine generators with fuel supplied by field gas, compressed natural gas (CNG), and/or liquefied natural gas (LNG), diesel turbine generators, diesel engine generators, natural gas engine generators, batteries, electrical grids, and the like. Moreover, these electric sources may include a single source type unit or multiple units. For example, there may be one gas turbine generator, two gas turbines generators, two gas turbine generators coupled with one diesel engine generator, and various other configurations.

In various embodiments, equipment at the well site may utilize 3 phase, 60 Hz, 690V electrical power. However, it should be appreciated that in other embodiments different power specifications may be utilized, such as 4160V or at different frequencies, such as 50 Hz. Accordingly, discussions herein with a particular type of power specification should not be interpreted as limited only to the particularly discussed specification unless otherwise explicitly stated. Furthermore, systems described herein are designed for use in outdoor, oilfield conditions with fluctuations in temperature and weather, such as intense sunlight, wind, rain, snow, dust, and the like. In embodiments, the components are designed in accordance with various industry standards, such as NEMA, ANSI, and NFPA.

As noted, suction stabilizers/dampeners are used to stabilize the fluid that is supplying the positive displacement plunger pumps used in fracturing operations. By maintaining a set charge to the dampener, the dampener may function efficiently, which provides advantages to the pumping process, such as reduced cavitation, prolonged fluid end life, and reduced jerking of the suction hose, which may reduce exterior wear.

Figure 2:
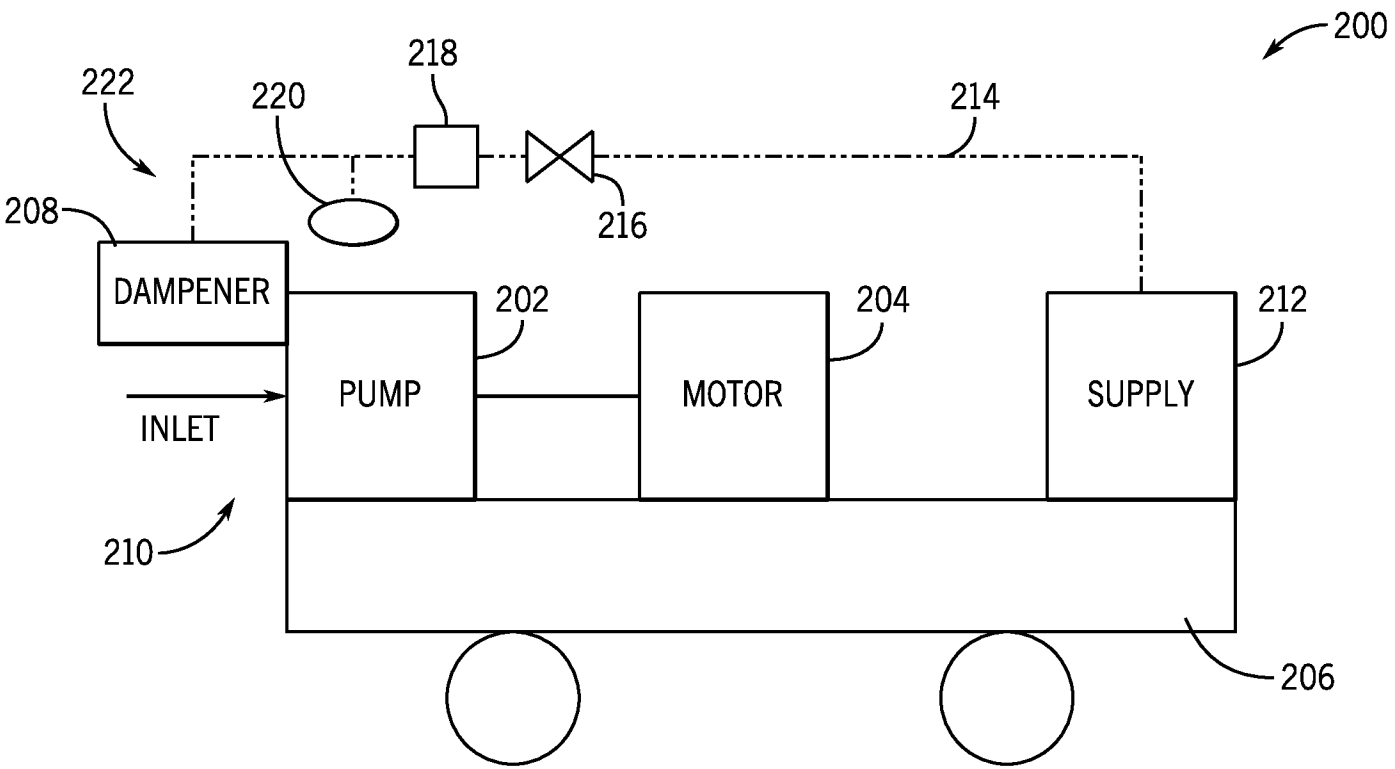
FIG. 2 is a block diagram of an embodiment of a pumping configuration for a fracturing operation, in accordance with embodiments of the present disclosure.

FIG. 2 is a schematic diagram of an embodiment of a piping configuration 200 that may be utilized with embodiments of the present disclosure. In the illustrated embodiment, a pump 202 and a motor 204 are arranged on a trailer 206, as described above. It should be appreciated that the trailer 205 is provided for convenience and by way of example only, and that in various embodiments the pump 202 and the motor 204 may be arranged on a skid, truck bed, or the like. Moreover, it should be appreciated that the motor 204 may be utilized to power more than one pump 202. The illustrated suctionstabilizer/dampener 208 is arranged at a suction side 210 of the pump 202. Typically, the suction stabilizer/dampener 208 remains charged by a compressed gas supply, such as air or nitrogen, that may utilize bottles or containers arranged proximate the trailer. Embodiments of the present disclosure utilize an available source, for example a supply 212 (e.g., an air supply) associated with the trailer 206, in order to provide the compressed gas to the suction stabilizer/dampener 208. In the illustrated embodiment, a hose 214, or other flow path (e.g., hard piping, flexible tubing, combinations thereof, etc.) is arranged between the supply 212 and the suction stabilizer/dampener 208. The illustrated hose 214 includes a valve 216, a regulator 218, and a pressure gauge 220. It should be appreciated that the valve 216 may be any kind of valve, such as a gate valve, globe valve, ball valve, needle valve, or any other reasonable valve. A connection 222 may be formed between the supply 212 and the suction stabilizer/dampener 208. The valve 216 may be opened and the regulator 218 may be moved to an open position and adjusted to a set pressure, for example approximately 90 psi. The pressure gauge 220 may be evaluated and once it reaches a desired pressure, the regulator 218 may be closed and the valve 216 may also be closed. Thereafter, the pressure gauge 220 may be monitored to determine whether additional compressed gas is needed.

It should be appreciated that embodiments may include an automatic or manual operation, or a combination of the two. For example, the pressure gauge 220 may be utilized to control one or more aspects, such as the regulator 218, Further, upon reaching a set pressure, a signal may be transmitted to the valve 216 to move to a closed position. Thereafter, upon detection of a pressure below a threshold, an alert may be transmitted and/or the supply 212 may be engaged to provide additional pressurized gas. In this manner, operators may reduce their maintenance operations, which may improve well site operations. Moreover, the benefits provided above may also be realized by the system by reducing the likelihood of under pressure in the suction stabilizer/dampener 208, thereby reducing potential damage to the system.

Figure 3:
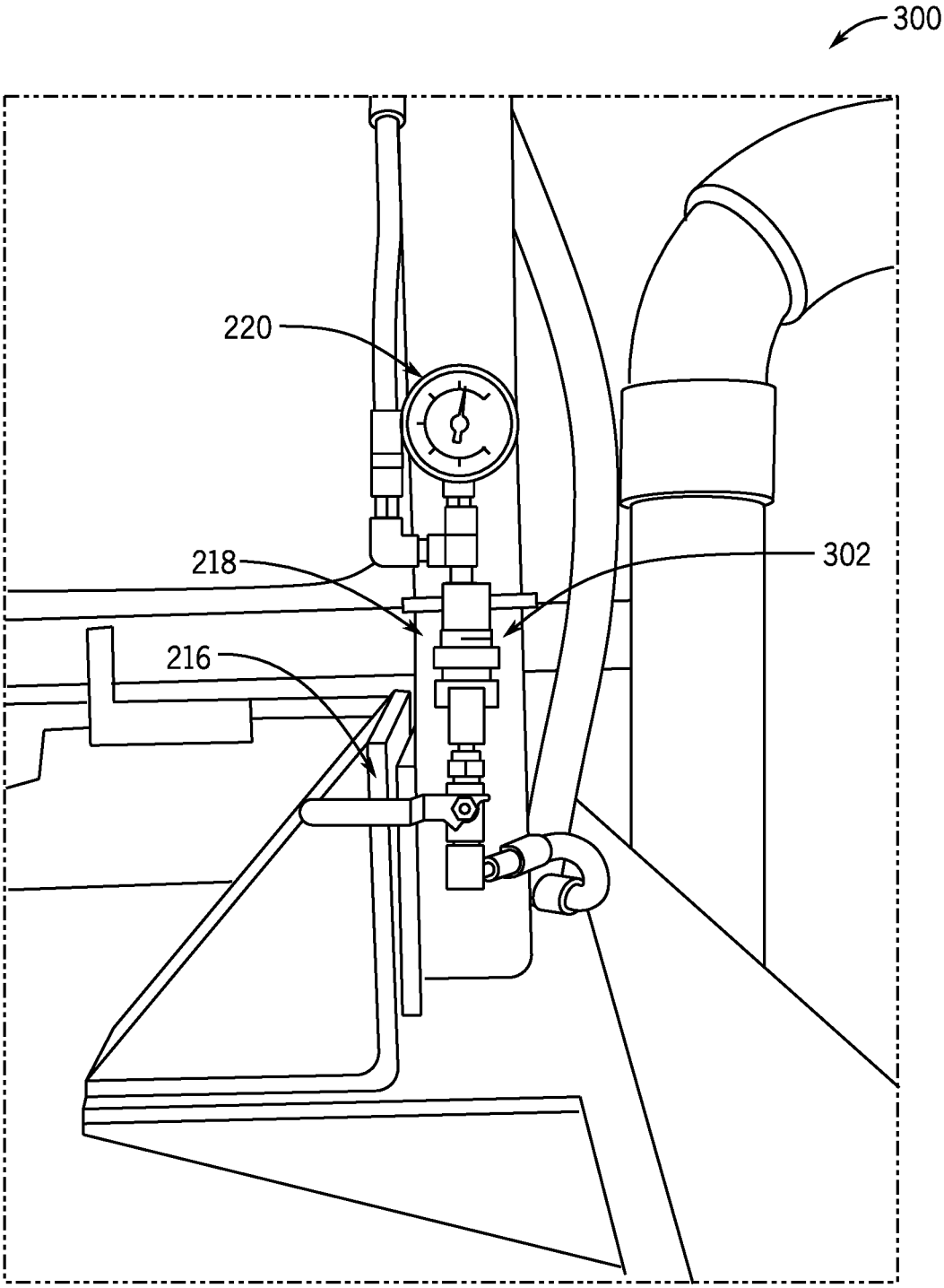
FIG. 3 is a schematic view of an embodiment of a piping configuration, in accordance with embodiments of the present disclosure.

FIG. 3 is a perspective view of an embodiment of a piping configuration 300 including the pressure gauge 220, the regulator 218, and the valve 216, which is a ball valve in the illustrated embodiment. In this example, the regulator 218 and the valve 216 are arranged in series such that the regulator 218 is downstream of the valve 216 relative to a flow direction. Accordingly, closing the valve 216 may block or otherwise restrict flow to the regulator 218. In this example, the regulator 218 may include a screw mechanism 302 that enables opening and closing of the regulator 218, as noted above. It should be appreciated that, in various embodiments, one or more features shown in FIG. 3 may be integrated. For example, the pressure gauge 220 may be integrated into the regulator 218. Furthermore, while manually operated components are illustrated in FIG. 3, it should be appreciated that automated components may also be utilized in embodiments of the present disclosure. As an example, the valve 216 may be an actuated valve that receives a signal from the gauge 220, which may be a sensor, to open and/or close the valve 216. Moreover, the gauge 220 (e.g., sensor) may also transmit a signal to the supply or compressor described above to recharge or refill the supply, thereby reducing operator interaction with the system.

It should be appreciated that embodiments may be directed toward one or more methods or a series of steps in order to charge the suction stabilizer/dampener 208. As an example, the system may be cleared of pressure before operations begin. Thereafter a compressor or other equipment associated with the supply 212 may be activated in order to fill the supply 212 with gas, such as compressed air or any other gas available at the site. Thereafter, the valve 216 may be open and the regulator 218 may be moved to an open position that permits air to flow toward the suction stabilizer/dampener 208. As the regulator 218 is open, the it may be set or otherwise adjusted to a particularly selected pressure and then locked into place once the gauge 220 reads the desired temperature. The valve 216 may then be closed and the gauge 220 and/or sensors may be utilized to monitor pressure within the suction stabilizer/dampener 208.

Figure 4:
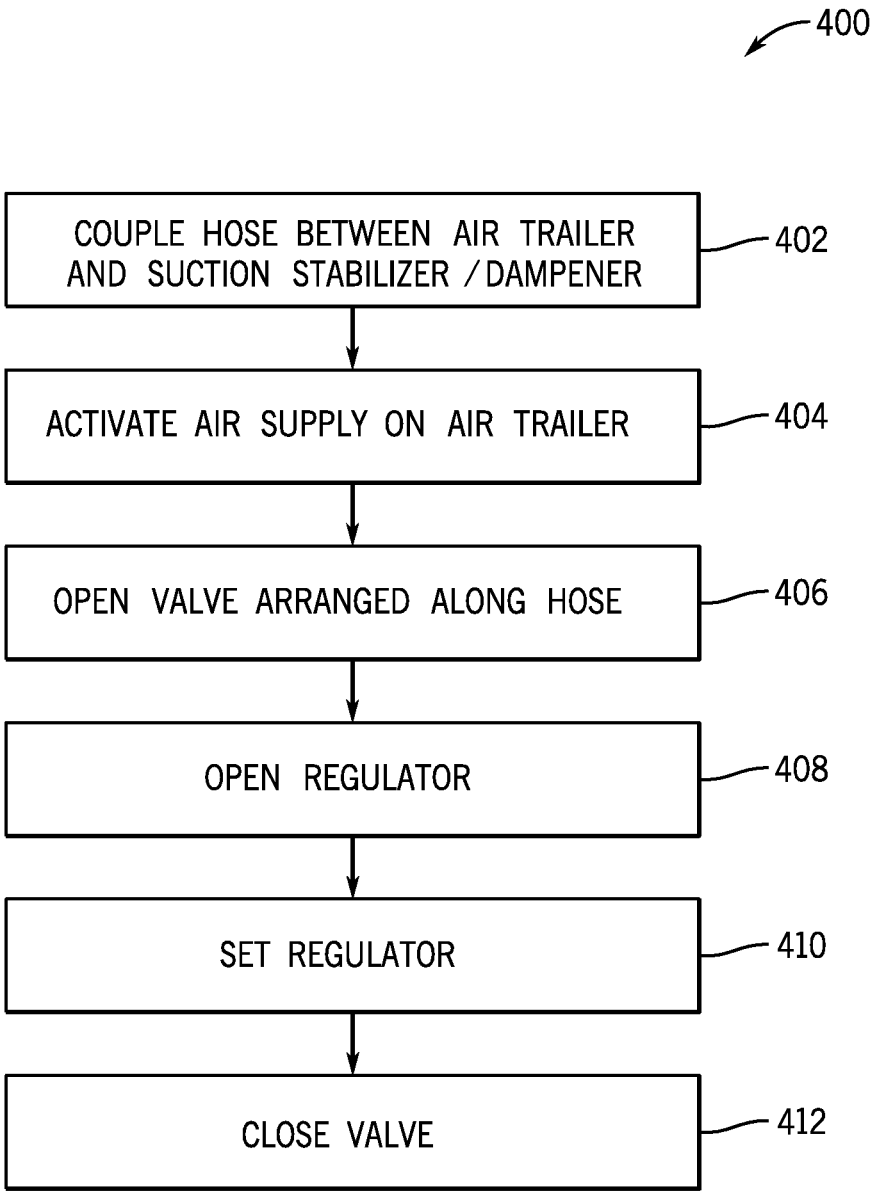
FIG. 4 is a flow chart of an embodiment of a method for charging a suction stabilizer/dampener, in accordance embodiments of the present disclosure.

FIG. 4 is a flow chart of a method 400 for providing pressurized gases, such as air, to the suction stabilizer/dampener. It should be appreciated that the method may include more or fewer steps and, moreover, that the steps may be performed in a different order or in parallel unless otherwise specifically stated. This example begins with coupling a hose between an air supply, such as an air supply on a trailer, and a suction stabilizer/dampener 402. It should be appreciated that the air supply may be a readily available supply or may be a supply arranged on site for the pumping process. The air supply may be activated, for example, by engaging a compressor 404. A valve along the hose may be opened and a regulator may be opened 406. As pressure reaches a desired level, the regulator may be set 410 and the valve is closed 412. Thereafter, an operator may monitor pressure to determine whether additional air is needed. As noted above, in various embodiments one or more steps may be automated and/or regulated by a pressure gauge, actuator, or the like.

Figure 5:
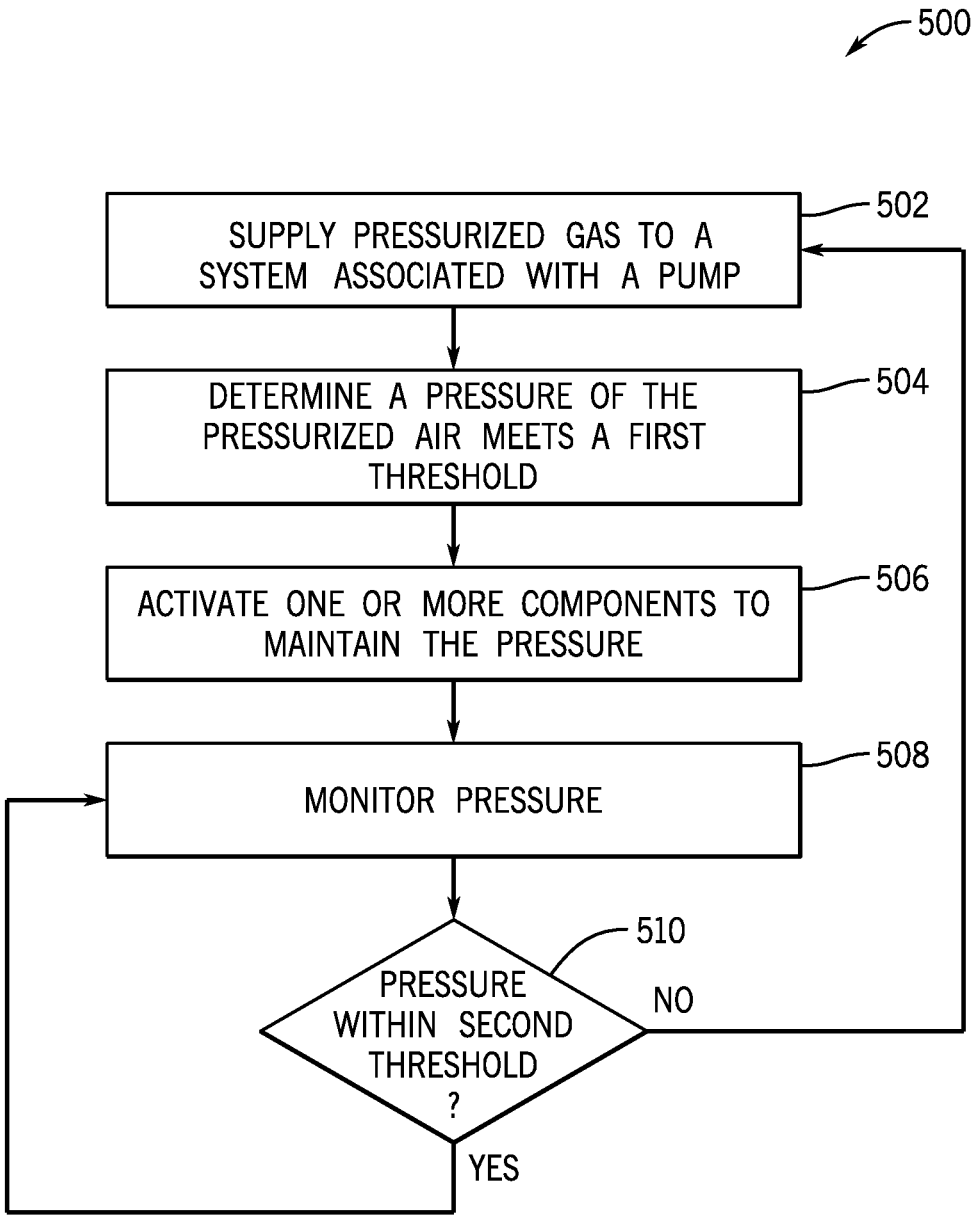
FIG. 5 is a flow chart of an embodiment of a method for charging a suction stabilizer/dampener, in accordance with embodiments of the present disclosure.

FIG. 5 is a flow chart of an embodiment of a method 500 for providing pressurized gases, such as air, to the suction stabilizer/dampener. In this example, pressurized gas is provided to a system associated with a pump 502. As noted above, the system may include one or more components of the present embodiments, including the suction stabilizer/dampener and/or the supply, among other components. The pressure of the system may be evaluated against a threshold to determine the pressure meets or exceeds a first threshold 504. For example, the first threshold may be a recommended operational range for the system. One or more components may be activated to maintain pressure within the system 506, such as the regulator and/or the valve. The pressure may be monitored 508. For example, a sensor may be utilized to monitor pressure in the system. A determination may be made whether the pressure is within a second threshold, which may include a range above or below the first threshold or a desired operating parameter. If the pressure is within the second threshold, then monitoring continues. If it is not, then additional pressurized gas may be supplied to the system. As noted above, one or more steps may be automated and/or controlled by a controller, which may include a processor and memory that includes machine readable instructions that may be executed by the processor.

Figure 6:
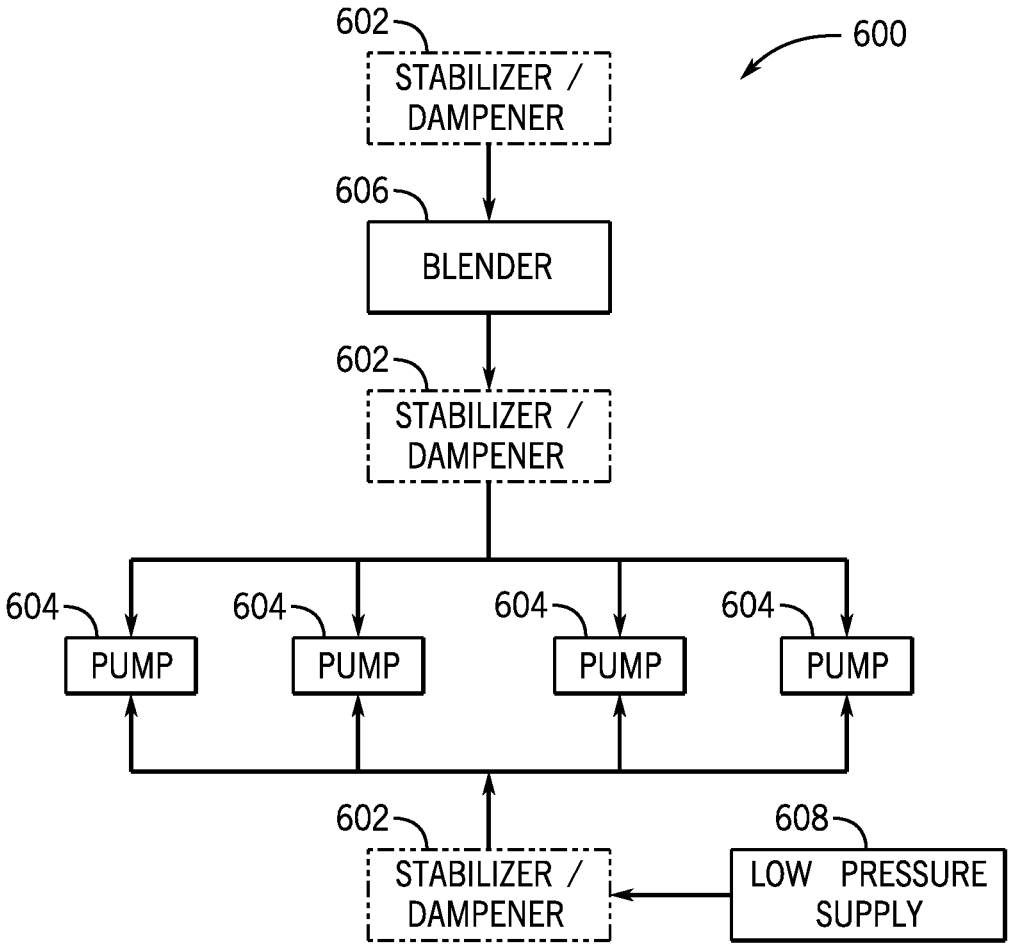
FIG. 6 is a schematic diagram of an embodiment of a pumping configuration, in accordance with embodiments of the present disclosure.

FIG. 6 is a schematic diagram on an embodiment of a pumping configuration 600 where individual stabilizer/dampeners for pumps have been replaced with a common stabilizer/dampener 602 that may be utilized with multiple pumps 604. In this example, the stabilizer/dampener 602 is arranged upstream of the pumps 604, but it should be appreciated that the stabilizer/dampener 602 may be positioned at various different locations. By way of example only, FIG. 6 illustrates the stabilizer/dampener 602 positioned upstream of a blender 606 and/or downstream of the blender 606. As noted above, different configurations may include replacement of individual pump suction dampeners/stabilizers with one single unit placed prior to the pumps. This could be on the suction side of the blender, the discharge side of the blender, on a supply missile or another location within the system. Additionally, multiple units that serve two or more pumps may be deployed. Accordingly, while the configuration illustrating the stabilizer/dampener 602 being utilized with four pumps 604, it should be appreciated that more or fewer pumps may be supported with the single stabilizer/dampener 602. Furthermore, as shown in the configuration of FIG. 6, the stabilizer/dampener 602 may also be arranged downstream of a low pressure supply 608, for example, such as a supply associated with a missile. Furthermore, it should be appreciated that multiple stabilizers/dampeners 602 may be incorporated into the system.

The present disclosure described herein, therefore, is well adapted to carry out the objects and attain the ends and advantages mentioned, as well as others inherent therein. While a presently preferred embodiment of the disclosure has been given for purposes of disclosure, numerous changes exist in the details of procedures for accomplishing the desired results. These and other similar modifications will readily suggest themselves to those skilled in the art, and are intended to be encompassed within the spirit of the present disclosure disclosed herein and the scope of the appended claims.

We claim:

1. A hydraulic fracturing pump system, comprising:
an electric powered hydraulic fracturing pump;
a suction stabilizer/dampener coupled to a suction end of the pump;
a compressed gas supply, fluidly coupled to the suction stabilizer/dampener; and
a control system positioned along a flow path between the suction stabilizer/dampener and the compressed gas supply, the control system comprising:
a valve;
a regulator; and
a sensor.

2. The hydraulic fracturing pump system of claim 1, wherein the regulator is configured at a set pressure, the set pressure corresponding to an operating pressure for the suction stabilizer/dampener.

3. The hydraulic fracturing pump system of claim 1, wherein the sensor is a pressure gauge.

4. The hydraulic fracturing pump system of claim 1, wherein the sensor is a pressure sensor configured to transmit a signal, to the valve, to regulate an open position or a closed position of the valve based, at least in part, on a pressure within the flow path.

5. The hydraulic fracturing pump system of claim 1, wherein the pump, the suction stabilizer/dampener, and the compressed gas supply are positioned on a common support structure.

6. The hydraulic fracturing pump system of claim 5, wherein the common support structure is one of a trailer, a skid, a platform, or a truck bed.

7. The hydraulic fracturing pump system of claim 1, further comprising:
a second electric powered hydraulic fracturing pump, the second electric powered hydraulic fracturing pump being coupled, at a second suction end, to the suction stabilizer/dampener.

8. A method for controlling a pumping operation, comprising:
charging a suction stabilizer/dampener via a compressed gas supply;
determining a charge pressure of the suction stabilizer/dampener is within a threshold of a target pressure;
setting a pressure control device, along a flow path between the suction stabilizer/dampener and the compressed gas supply; and
operating a hydraulic fracturing pump coupled to the suction stabilizer/dampener.

9. The method of claim 8, further comprising:
positioning the compressed gas supply on a support structure, the support structure including the hydraulic fracturing pump.

10. The method of claim 8, further comprising:
determining the charge pressure is outside of the threshold;
operating a valve to permit flow along the flow path; and
increasing the charge pressure.

11. The method of claim 10, wherein the determining and the operating are conducted remotely.

12. The method of claim 10, wherein the determining is performed by a pressure sensor configured to transmit a signal to the valve.

13. The method of claim 10, wherein the valve is a ball valve with an actuator that, responsive to the determining, moves the ball valve between an open position and a closed position.

14. A hydraulic fracturing pump system, comprising:
an electric powered hydraulic fracturing pump positioned on a support structure;
a suction stabilizer/dampener coupled to a suction end of the pump;
a compressed gas supply, fluidly coupled to the suction stabilizer/dampener, and positioned on the support structure; and
a flow path between the suction stabilizer/dampener and the compressed gas supply, the flow path including at least one valve and at least one regulator configured to control flow from the compressed gas supply to the suction stabilizer/dampener.

15. The hydraulic fracturing pump system of claim 14, wherein the regulator is configured at a set pressure, the set pressure corresponding to an operating pressure for the suction stabilizer/dampener.

16. The hydraulic fracturing pump system of claim 14, further comprising:
a blender positioned upstream of the electric powered hydraulic fracturing pump, wherein the suction stabilizer/dampener is positioned in at least one of a downstream position or an upstream position with respect to the blender.

17. The hydraulic fracturing pump system of claim 14, herein the sensor is a pressure sensor configured to transmit a signal, to the valve, to regulate an open position or a closed position of the valve based, at least in part, on a pressure within the flow path.

18. The hydraulic fracturing pump system of claim 14, further comprising:
an electric motor configured to drive operation of the pump, the electric motor positioned on the support structure.

19. The hydraulic fracturing pump system of claim 14, wherein the support structure is one of a trailer, a skid, a platform, or a truck bed.

20. The hydraulic fracturing pump system of claim 14, wherein the compressed gas within the supply is at least one of air or nitrogen.

* * * * *